US011766805B2

(12) United States Patent
Cao et al.

(10) Patent No.: US 11,766,805 B2
(45) Date of Patent: Sep. 26, 2023

(54) CHAIN SAW

(71) Applicant: Globe (Jiangsu) Co., Ltd., Changzhou (CN)

(72) Inventors: Yuexun Cao, Changzhou (CN); Yinan Guo, Changzhou (CN); Tao Wang, Changzhou (CN); Lingao Zhang, Changzhou (CN)

(73) Assignee: Globe (Jiangsu) Co., Ltd., Changzhou (CN)

( * ) Notice: Subject to any disclaimer, the term of this patent is extended or adjusted under 35 U.S.C. 154(b) by 158 days.

(21) Appl. No.: 17/460,314

(22) Filed: Aug. 30, 2021

(65) Prior Publication Data

US 2022/0097250 A1 Mar. 31, 2022

(30) Foreign Application Priority Data

Sep. 28, 2020 (CN) ..... 202022162268.9

(51) Int. Cl.
*B27B 17/14* (2006.01)
*B27B 17/00* (2006.01)
*B27B 17/02* (2006.01)

(52) U.S. Cl.
CPC ..... *B27B 17/14* (2013.01); *B27B 17/0008* (2013.01); *B27B 17/02* (2013.01)

(58) Field of Classification Search
CPC ..... B27B 17/14; B27B 17/0008; B27B 17/02; B27B 17/00
USPC ..... 30/386
See application file for complete search history.

(56) References Cited

U.S. PATENT DOCUMENTS

2012/0005905 A1* 1/2012 Brown ..... A01G 3/086 30/383

FOREIGN PATENT DOCUMENTS

CN 203726573 U * 7/2014
CN 203726573 U 7/2014
DE 202015004337 U1 * 11/2015 ..... B27B 17/14

* cited by examiner

*Primary Examiner* — Nhat Chieu Q Do

(57) ABSTRACT

A chain saw includes a housing, a motor, a chain saw bar assembly, a tensioning assembly set on the housing, and an adjustment assembly set on the side cover corresponding to the tensioning assembly. The chain saw bar assembly is detachably connected to the first housing through the combination of the tensioning assembly and the elastic components, the adjustment assembly is movably connected with the tensioning assembly, and the adjustment assembly can adjust the relative position of the tensioning assembly and the guide shaft, to tension the chain set on the circumferential direction of the guide bar and tightly lock the chain saw bar assembly between the first housing and the side cover.

8 Claims, 4 Drawing Sheets

CHAIN SAW

CROSS-REFERENCE TO RELATED APPLICATIONS

This application claims priority to and the benefit from Chinese Patent Application No. CN202022162268.9, filed on Sep. 28, 2020, the disclosure of which is hereby incorporated by reference herein in its entirety for all purposes.

TECHNICAL FIELD

The disclosure relates to a garden tool, in particularly, a chain saw.

BACKGROUND

A chain saw is a garden tool that cut wood or branches with a saw chain driven by a power unit, if the saw chain is not properly installed, for example, if the saw chain is not properly installed in the guide bar groove, when the machine is turned on to cut, the saw chain is very loose, and it may break away from the guide bar and cause injury to the operator. For the safe operation of the chain saw, the saw chain is required to be placed in the guide bar groove channel correctly and reliably, but because the length of the saw chain cannot be completely consistent, including the length before and after use will also change, the positioning and adjustment solution of the guide bar and the conventional saw chain is generally known as: while installing the guide bar and the saw chain, external tools are used for manual adjustment, so as to install them in the appropriate position; during the installing process, one hand needs to keep the guide bar so that the saw chain will not be detached or loose, and the other hand needs to operate the installation side cover and knob, this installing process is cumbersome and the user's experience is poor; at the same time, when conventional two-functional handwheel with tensioning saw chain and fastening guide bar, is repeatedly installed and fastened, the initial docking between the guide parts is not good, the guide parts can be initially placed on the wall of the guide groove channel, which causes the runout of the handwheel when it rotates, which is not conducive to the fastening and tensioning of the saw chain.

In view of this, it is necessary to provide a new chain saw to solve the above problems.

SUMMARY

The disclosure provides a handheld chain saw, the chain saw is easy to install, and comprises a tensioning assembly and an adjustment assembly to automatically assemble and position the guide bar and saw chain on the housing, so that the whole installing process of the saw chain is smooth, to avoid runout which affects the installing and positioning of the chain saw bar assembly.

The disclosure provides a chain saw, the chain saw comprising a housing, the housing comprises a first housing and a second housing snap-fitted together, and a side cover detachably connected to the outside of the first housing, the housing also includes a first handle formed on the first housing and the second housing; a motor, the motor is accommodated in the first housing and the second housing; and a chain saw bar assembly, the chain saw bar assembly comprising a guide bar extending to a first direction and the saw chain set around the circumferential direction of the guide bar, the first direction being the extension direction from the first handle to the chain saw bar assembly; the chain saw also comprising a tensioning assembly set on the housing and an adjustment assembly set on the side cover corresponding to the tensioning assembly, wherein the chain saw bar assembly is detachably connected to the first housing through the cooperation of a tensioning assembly and an adjustment assembly; the tensioning assembly comprises a guide shaft set along the first direction, and a tensioning unit, a first elastic component and a second elastic component which are slidably set on the guide shaft; the first and second elastic components limit the relative position of the tensioning unit and the guide shaft; and the adjustment assembly is movably connected to the tensioning unit, and the adjustment assembly can adjust the relative position of the tensioning unit and the guide shaft, to lock the saw chain arranged in tension in the circumferential direction of the guide bar and the chain saw bar assembly between the first housing and the side cover.

As a further improvement to the disclosure, the first elastic component and the second elastic component are both sleeved on the guide shaft, and the tensioning unit is located between the first elastic component and the second elastic component.

As a further improvement to the disclosure, along the first direction, the first elastic component is located behind the second elastic component, and the first elastic component is shorter on the length compared to the second elastic component, so that the tensioning unit deviates toward a side of the first elastic component at an initial position.

As a further improvement to the disclosure, the tensioning assembly comprises a compressing block, an end of the second elastic component away from the tensioning unit abuts again the compressing block, to limit the move distance of the tensioning assembly along the first direction.

As a further improvement to the disclosure, the tensioning assembly comprises a positioning protrusion extending towards the side cover and a holding protrusion which is set displaced to the positioning protrusion, and an extending length of the positioning protrusion is longer than that of the holding protrusion.

As a further improvement to the disclosure, the chain saw bar assembly is positioned on an outside wall of the first housing by the positioning protrusion and the holding protrusion, and the guide bar comprises a sliding slot set corresponding to the positioning protrusion and a holding hole set corresponding to the holding protrusion.

As a further improvement to the disclosure, the adjustment assembly comprises a threaded column penetrating through the side cover and being connected to an outside wall of the first housing, a hand wheel rotatably connected to an end of the threaded column, and a locking part sleeved on the threaded column and accommodated in the hand wheel; and the locking part can move along the extension direction of the threaded column driven by the hand wheel, so as to fasten or loosen the chain saw bar assembly between the first housing and the side cover.

As a further improvement to the disclosure, a blocking wall protruding along the direction of the tensioning assembly is formed on the locking part, the blocking wall spiraling hovering around the threaded column, to form a spiral groove to clamp the tensioning unit; the chain saw bar assembly provides a positioning protrusion to be clamped by the spiral groove, and the positioning protrusion can relatively slide in the spiral groove, so as to make the guide bar move along the first direction forth and back.

As a further improvement to the disclosure, a convex plate is set on the first housing, the convex plate is set with an accommodating groove to accommodate the tensioning assembly, and the chain saw bar assembly is locked and connected between the convex plate and the side cover by the cooperation of the tensioning assembly and the adjustment assembly.

As a further improvement to the disclosure, the motor comprises a chain wheel for driving the chainsaw bar assembly, and the chain wheel penetrates through the outside wall of the first housing and is located between the side cover and the first housing.

The beneficial effect of the disclosure is that the chain saw is set with the tensioning assembly and the adjustment assembly for tensioning and locking the chain saw bar assembly, to automatically adjust the installation of the chain saw bar assembly, and the positioned chain saw bar assembly is further fastened and locked through the adjustment assembly; which makes the installation of the chainsaw disclosed in this disclosure easier, makes the whole installing process of the chain saw bar assembly smooth, and avoids runout of the saw chain during the installing process which affects the installing and tensioning of the chain saw bar assembly.

DETAILED DESCRIPTION

In order to make the objectives, technical solutions and advantages of the present invention clearer, the present invention will be described in detail below with reference to the accompanying drawings and specific embodiment.

Figure 1:
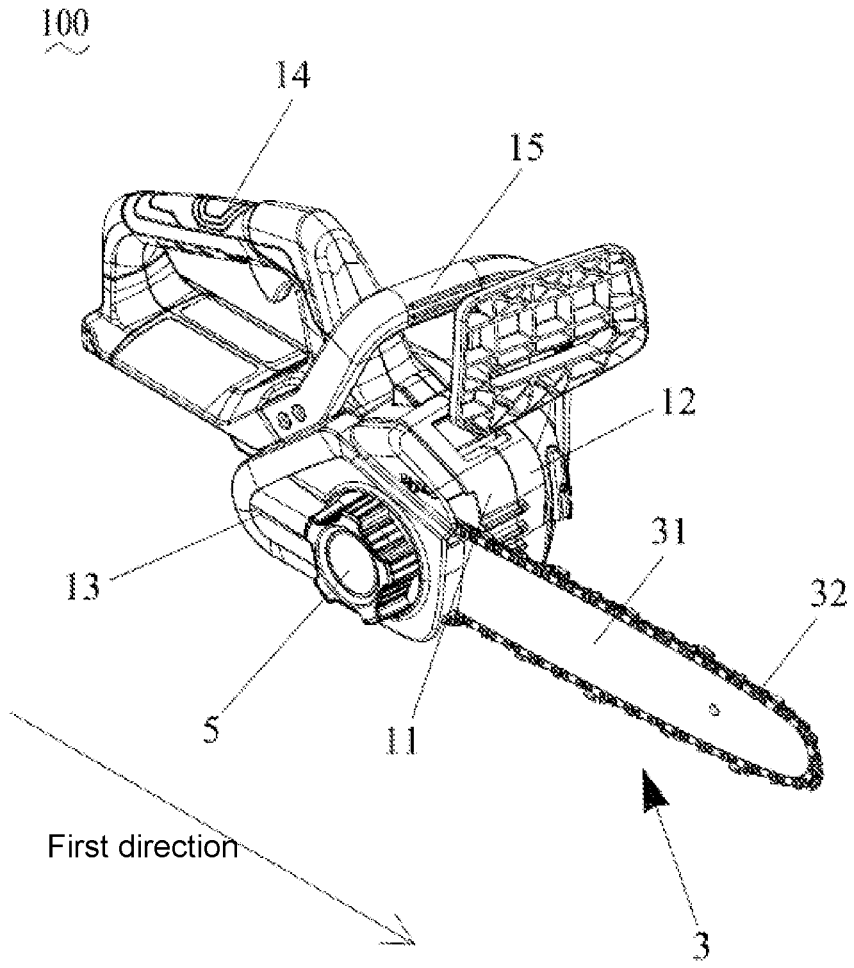
FIG. 1 is a perspective view of the chain saw in this disclosure.
Figure 2:
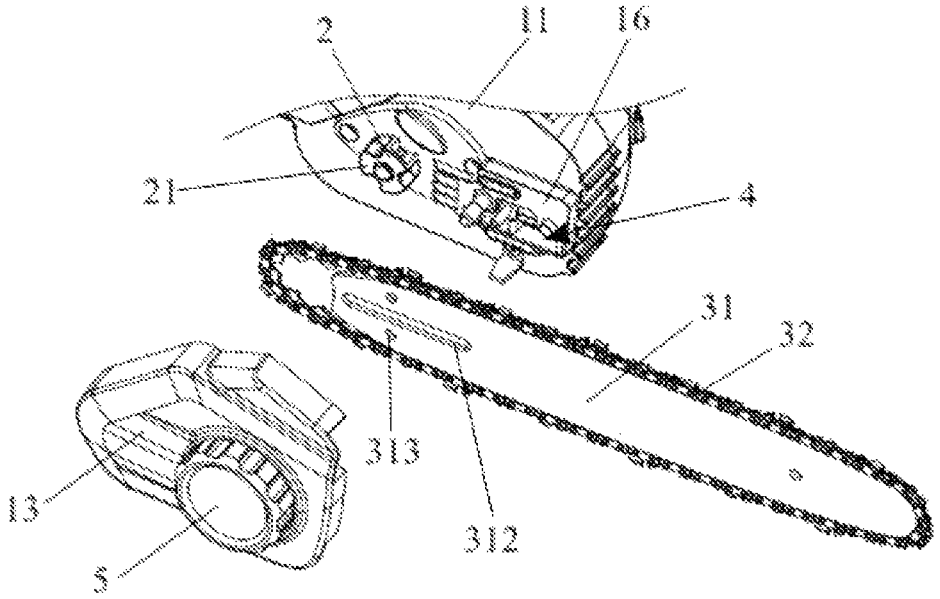
FIG. 2 is a partially exploded structure diagram of the chain saw in FIG. 1.

As shown in FIG. 1 and FIG. 2, a chain saw 100 is provided by the disclosure, the chain saw 100 comprises a housing 1, a motor accommodated in the housing 1, and a chain saw bar assembly 3 driven by the chain wheel 2 on the motor.

The housing 1 comprises a first housing 11, and a second housing 12, and a side cover 13 detachably connected to the outside wall of the first housing 11. Further, the housing 1 also includes a first handle 14 formed on the first housing 11 and the second housing 12, and a second handle 15 detachably connected to the first housing 11 and the second housing 12. According to FIG. 1, a first direction is defined as an extension direction from the first handle 14 to the chain saw bar assembly 3.

A motor is applied to provide power to drive the chain saw bar assembly 3 to operate, in this disclosure the motor is accommodated in the residential space formed by the first housing 11 and the second housing 12 snap-fitted together, and the motor comprises a chain wheel 2 in drive connection with the chain saw bar assembly 3.

The chain wheel 2 penetrates through the outside wall of the first housing 11 towards the side cover 13 and is located between the outside wall and the side cover; further, meshing teeth 21 are set on the extension end of the chain wheel 2 for driving and connecting to the chain saw bar assembly 3; and the meshing teeth 21 can be driven by the motor to rotate so as to drive the chain saw bar assembly 3.

Figure 3:
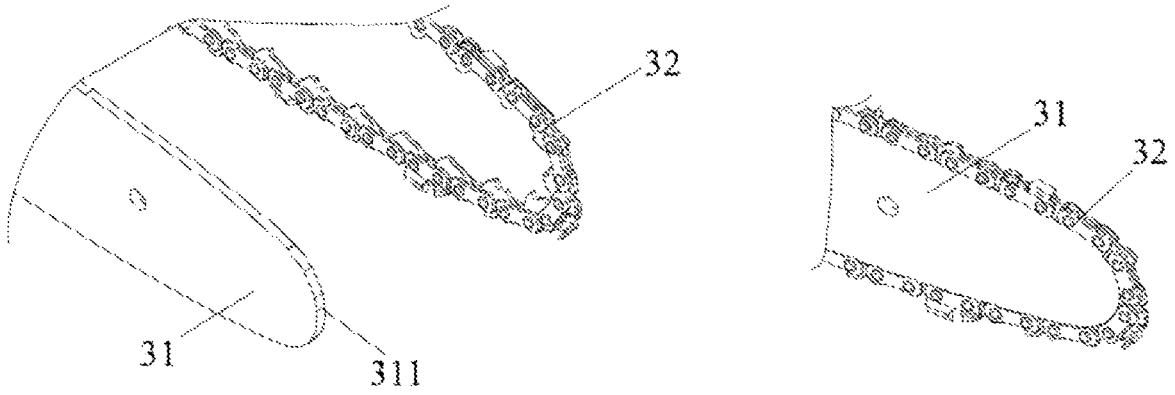
FIG. 3 a partial structure diagram and an exploded diagram of the chain saw bar assembly in FIG. 1.
Figure 4:
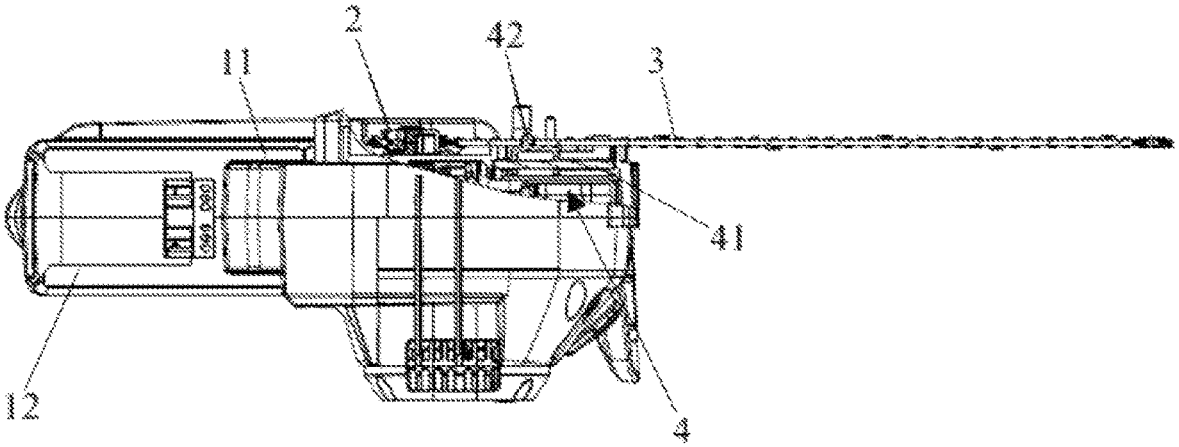
FIG. 4 is a partial cross-sectional diagram from the other angle after hiding the side cover and the adjustment assembly in FIG. 1.
Figure 5:
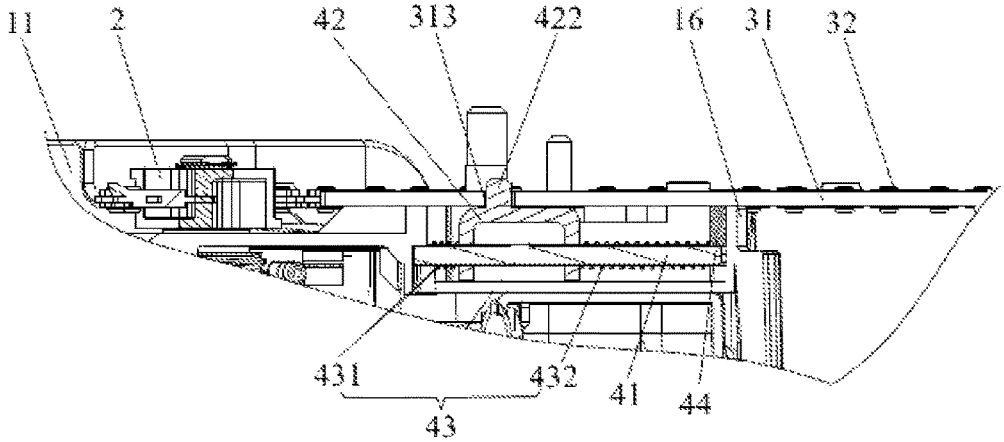
FIG. 5 is a partially enlarged diagram of the section part in FIG. 4.

As shown in FIG. 2 and FIG. 3, the chain saw bar assembly 3 comprises a guide bar 31 extending along the first direction and a saw chain 32 set around the circumferential direction of the guide bar 31; the guide bar 31 comprises a first end (not numbered) held between the outside wall of the first housing 11 and the side cover 13, and a second end extending externally from the gap between the outside wall of the first housing 11 and the side cover 13; by such setting, the waggling of the guide bar 31 on the vertical direction can by efficiently avoided.

Further, the circumferential edge of guide bar 31 is provided with a connection grooves 311, the saw chain 32 is meshing connected with the guide bar 31 through the connection grooves 311, and saw chain 32 is meshing connected with the chain wheel 2 through the meshing teeth 21. In this disclosure, the saw chain 32 can rotate driven by chain wheel 2 and supported by the guide bar 31.

As shown in FIG. 2, and FIG. 4 to FIG. 7, the chain saw 100 also comprises a tensioning assembly 4 set on the housing 1 and an adjustment assembly 5 set on the side cover 13 corresponding to the tensioning assembly 4. The chain saw bar assembly 3 is tightly locked and fixed between the first housing 11 and the side cover 13 through the combination of the tensioning assembly 4 and the adjustment assembly 5, and the adjustment assembly 5 can further adjust the tension between the saw chain 32 and the guide bar 31, also can limit the locking force of the chain saw bar assembly 3.

The tensioning assembly comprises a guide shaft 41 set along the first direction, a tensioning unit 42 and an elastic component 43. The tensioning unit 42 and the elastic component 43 are slidably connected on the guide shaft 41. In this disclosure, the tensioning assembly 4 is located approximately between the first end of the guide bar 31 and the chain wheel 2, to primarily tension the saw chain 32 set on the guide bar 31 and the chain wheel 2.

The guide shaft 41 is fixed on the first housing 11, the tensioning unit 42 and the elastic component 43 are both provided with through holes (not numbered) for the guide shaft 41 to go through. The tensioning unit 42 and the elastic component 43 are slidably connected on the guide shaft 41 through the through holes, therefor can slide along the guide shaft 41.

In an embodiment of the disclosure, the outside wall of the first housing 11 is provided with a convex plate 16 set between the first housing 11 and the side cover 13. The chain saw bar assembly 3 is connected to the convex plate 16 through the tensioning assembly 4 and the adjustment assembly 5. Further, the convex plate 16 is set with an accommodating groove 161 sinking towards the inside of the first housing 11, and the tensioning assembly 4 is accommodated in the accommodating groove 161.

In this disclosure, the guide shaft 41 is accommodated in the accommodating groove 161, and the guide shaft 41 is parallel with the guide bar 31 and extends along the first direction; further, the tensioning unit 42 is approximately set as an L-shape, the accommodating groove 161 is approximately set as an inverted T-shape, so as to ease the sliding of the tensioning unit 41 along the guide shaft 41 and limit the sliding distance of the tensioning unit 41; a positioning protrusion 421 extending towards the side cover and a holding protrusion 422 dislocated to the positioning protrusion 421, are respectively set on the two extending ends of the tensioning unit 42.

The chain saw bar assembly 3 is positioned on the convex plate 16 by the positioning protrusion 421 and the holding protrusion 422, and the first end of the guide bar 31 is provided with a sliding slot 312 corresponding to the positioning protrusion 421 and a holding hole 313 corresponding to the holding protrusion 422, and in this disclosure, the sliding slot 312 is a kidney slot extending along the first direction, the holding hole 313 is a through hole corresponding to the holding protrusion 422, and the positioning protrusion 421 is longer on the extending length penetrating through the guide plate 31 compared to the holding protrusion 422; further, the guide bar 31 is fixed on the surface of the convex plate 16 by a nut (not numbered) which goes through the sliding slot 312, and the guide bar 31 can move along the sliding slot 312.

The elastic component 43 comprises a first elastic component 431 and a second elastic component 432 sleeved on the guide shaft 41, and the tensioning unit 42 is located between the first elastic component 431 and the second elastic component 432; along the first direction, the first elastic component 431 is located behind the second elastic component 432, and the first elastic component 431 is shorter on the length compared to the second elastic component 432, so that the tensioning unit 42 deviates to the side of the first elastic component 431 at the initial position.

The tensioning assembly 4 further comprises a compressing block 44. The compressing block 44 is used to fix the guide shaft 41 inside the accommodating groove 161 and is located at the end of the guide shaft 41 extending along the first direction. An end that is away from the tensioning unit of the second elastic component 432 abuts on the compressing block 44. Such setting is used to limit the move distance of the tensioning assembly along the first direction, to prevent the saw chain 32 from breaking due to excessive tension.

Figure 6:
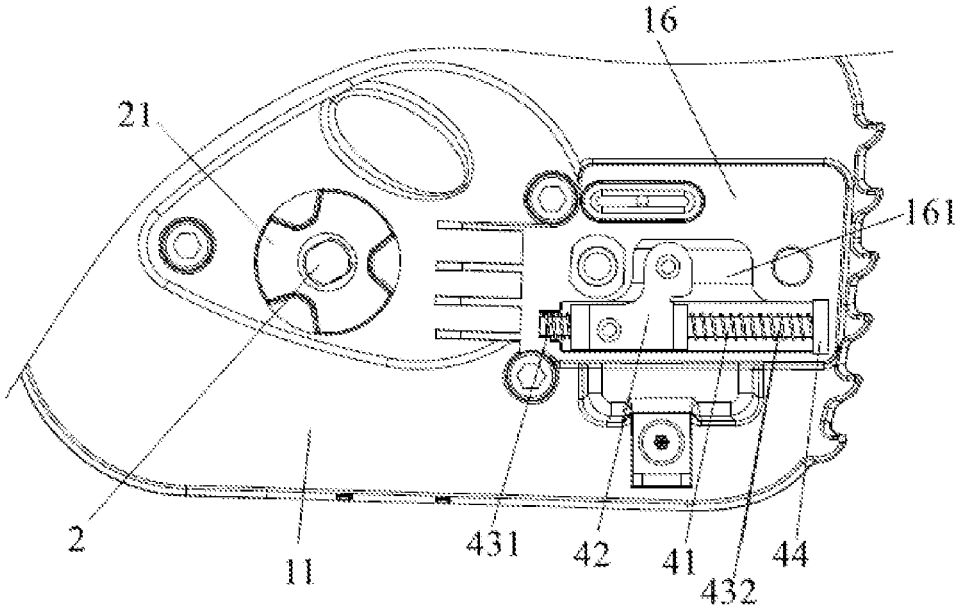
FIG. 6 is a partially enlarged diagram of the assembly position of the first housing and the tensioning assembly.
Figure 7:
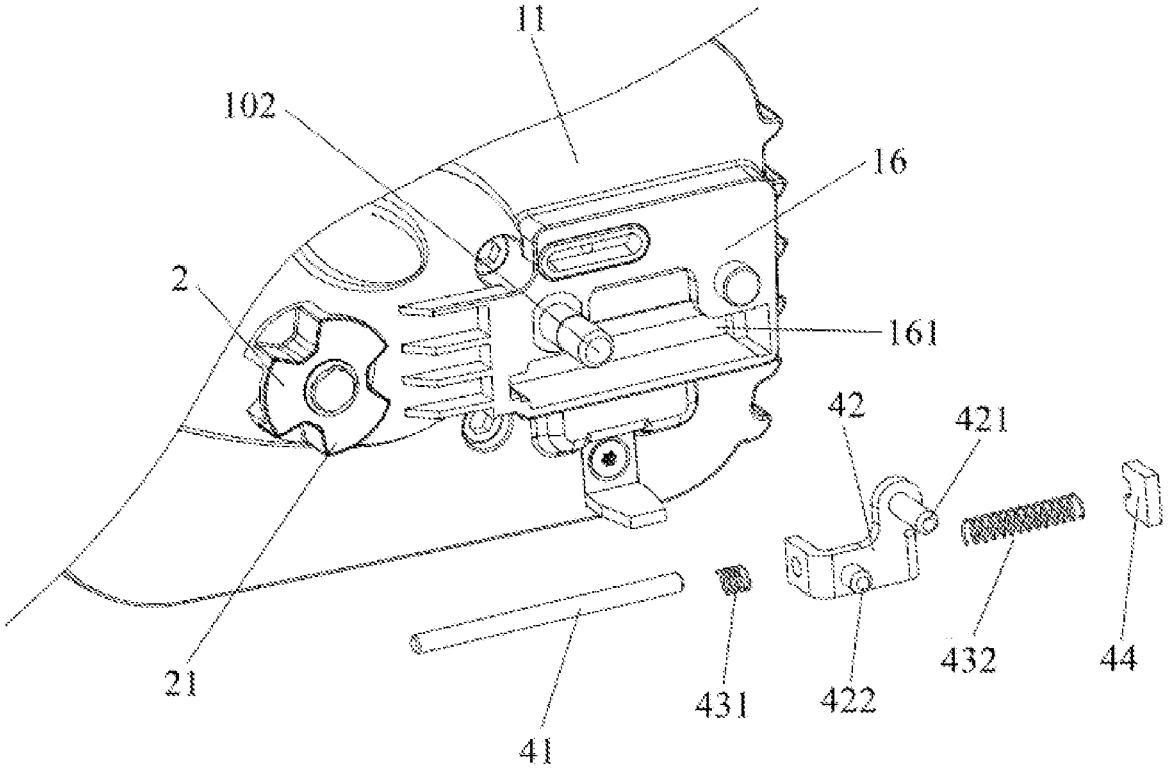
FIG. 7 is an exploded diagram of the assembly position of the first housing and the tensioning assembly.
Figure 8:
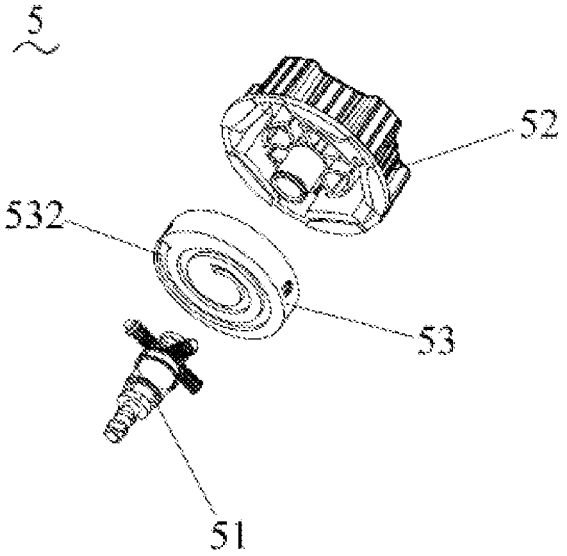
FIG. 8 is an exploded diagram of the adjustment assembly in FIG. 1.
Figure 9:
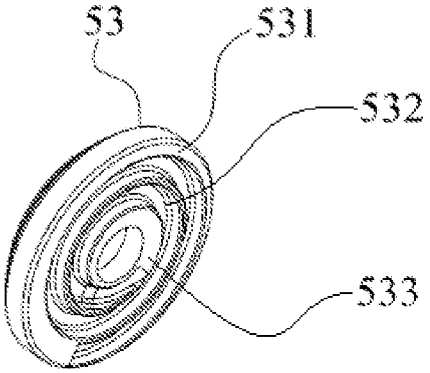
FIG. 9 is a perspective view of the locking part in FIG. 8.

As shown in FIG. 6 to FIG. 8, the adjustment assembly 5 can provide two functions including tensioning the saw chain 32 and locking the chain saw bar assembly 3. The adjustment assembly 5 comprises a threaded column 51 penetrating through the side cover 13 and rotatably connected to the threaded rod 102, a hand wheel 52 arranged at the end of the threaded column 51, and a locking part 53 sleeved on the threaded column 51 and accommodated in the hand wheel 52. The relative position of the locking part 53 and the hand wheel 52 to the threaded column 51 can be adjusted.

The threaded column 51 is connected on the outside wall of the first housing 11 and penetrates through the side cover 13 to connect the locking part 53 and the hand wheel 52; the hand wheel 52 is set as a hollow structure with groove, further, the locking part 53 is held and fixed inside the hand wheel 52, and the locking part 53 can move along the extending direction of the threaded column 51 driven by the hand wheel 52, so as to lock or loose the chain saw bar assembly 3 between the first housing 11 and the side cover 13, and realize the locking function for the chain saw bar assembly 3. In an embodiment of the disclosure, a stopping structure (not numbered) is set on the outer surface of the locking part 53 for limiting the relative position of the locking member 53 and the hand wheel 52, and the stopping structure is set to limit the relative slide between the locking part 53 and the hand wheel 52.

Further, the locking part 53 is formed with a blocking wall 531 protruding towards the tensioning assembly 4, the blocking wall 531 spiraling hovering around the threaded column 51, to form a spiral groove 532 to hold the tensioning unit 42; the setting of the spiral groove 532 can realize the tensioning function of the adjustment assembly 5 for the saw chain 32.

In detail, the positioning protrusion 421 is set to be held in by the spiral groove 532, then by turning the hand wheel 52, the positioning protrusion 421 can slide in the spiral groove 532 along the spiral line, so as to make the tensioning unit 42 slide along the guide shaft 41 in the accommodate groove 161 and simultaneously drive the guide bar 31 to move along the first direction or the opposite of the first direction, so as to adjust the tension between the saw chain 32 and the guide bar 31; and in this disclosure the spiral groove 532 is set around the initial position of the threaded column 51, and the guide bevel 533 is located at the center of the spiral groove 532, by this setting, the positioning protrusion 421 can slide along the guide bevel 533 into the spiral groove 532, which avoids the positioning protrusion 421 of the tensioning unit 42 from being held on the blocking wall 531 to make the locking part 53 incapable of working normally.

In an embodiment, the blocking wall 531 is set with chamfer on the extension end, by this setting, when the locking part 53 is held and fixed with the tensioning unit 42, the extending end of the positioning protrusion 421 is pressed on the bevel of the chamfer, and can slide on the bevel of the chamfer along the guide shaft 41 to compress the elastic components 43, which further ease the coupling of the tensioning assembly 4 and the adjustment assembly 5.

While installing and using the chain saw 100 of this disclosure, the tensioning unit 42 is in the initial position, meanwhile, the force from the first elastic component 431 to the tensioning unit 42 is lower than the force from the second elastic component 432 to the tensioning unit 42, the tensioning unit 42 deviates to the opposite of the first direction for a certain distance. When installing or changing of the guide bar 31 and the saw chain 32 is needed, firstly aim the sliding groove 312, holding hole 313 of the guide bar 31 respectively to the positioning protrusion 421 and the holding protrusion 422 on the tensioning unit 42, preliminarily position the guide bar 31 on the convex plate 161 by the bult and set the threaded column 51 through the sliding groove 312; then set the saw chain 32 in the connection grooves 311 along the circumferential direction of the guide bar 31, compress the first elastic component 431 on the opposite of the first direction by the guide bar 31, so as to hang one end of the saw chain 32 onto the meshing teeth 21 of the chain wheel 2; after this, the tensioning unit 42 driven by the restoring force of the elastic component 431 pushes the guide bar 31 along the first direction, so as to make the saw chain 32 uniformly arranged in the connection grooves 311 along the circumferential direction of the guide bar 31, which achieves the preliminary tensioning and positioning of the chain saw bar assembly 3.

Then, snap-fit the side cover 13 onto the first housing 11, next, sleeve the locking part 53 and the hand wheel 52 on the threaded column 51 successively and fix to each other, at this time, hand wheel 52 is rotated to make the locking part 53 move towards the tensioning unit 42, the tensioning unit 42 is pushed by the blocking wall 531 or the guide bevel 533 to compress the first elastic component 431 or the second elastic component 432, so as to make the positioning protrusion 421 precisely held in the spiral groove 532, then, continue to rotate the hand wheel 52 can lock the chain saw bar assembly 3 between the convex plate 16 and the side cover 13 along the extension direction of the threaded column 51, and also can tension the saw chain 32, which can avoid the detachment or looseness of the saw chain 32 from the guide bar 31 and greatly improves the ease of use and installation of the chain saw 100.

To sum up, the chain saw 100 of this disclosure, can automatically adjust the installing and positioning of the chain saw bar assembly 3 via the tensioning assembly 4 and the adjustment assembly 5, meanwhile, can further lock and fix the chain saw bar assembly 3 via the adjustment assembly 5, which makes the installation of the chain saw 100 of this disclosure easy, and makes the installation of the chain smooth, the saw chain 32 is prevented from jumping in the installation process of chain saw bar assembly 3 to affect the installing and tensioning of the chain saw bar assembly.

The above embodiment is only explanation of the disclosure other than limitation, although the favored embodiment is referred to detailly explain the disclosure, those skilled in the art should understand, modifying or equivalent replacement on this disclosure can be performed without deviate from the spirit and scope covered by this disclosure.

What is claimed is:

1. A chain saw comprising:

a housing, comprising a first housing, a second housing, a side cover and a first handle, wherein the side cover is detachably connected to an outside of the first housing, and the first handle is formed on the first housing and the second housing;

a motor, accommodated in between the first housing and the second housing;

a chain saw bar assembly, comprising a guide bar extending to a first direction, and a saw chain set around the circumferential direction of the guide bar, the first direction being direction from the first handle to the chain saw bar assembly;

a tensioning assembly set on the housing, and an adjustment assembly set on the side cover corresponding to the tensioning assembly, wherein, the chain saw bar assembly is detachably connected to the first housing through the cooperation of the tensioning assembly and the adjustment assembly;

the tensioning assembly comprises a guide shaft set along the first direction, and a tensioning unit, a first elastic component and a second elastic component which are slidably set on the guide shaft, the first and second elastic components limiting the relative position of the tensioning unit and the guide shaft;

the tensioning assembly comprises a positioning protrusion extending towards the side cover and a holding protrusion which is set displaced to the positioning protrusion, and an extending length of the positioning protrusion is longer than that of the holding protrusion, the chain saw bar assembly is positioned on an outside wall of the first housing by the positioning protrusion and the holding protrusion, and the guide bar comprises a sliding slot set corresponding to the positioning protrusion and a holding hole set corresponding to the holding protrusion; and the adjustment assembly is movably connected to the tensioning unit, and the adjustment assembly adjust the relative position of the tensioning unit and the guide shaft, to tension the saw chain set on the circumferential direction of the guide bar and to lock the chain saw bar assembly between the first housing and the side cover.

2. The chain saw according to claim 1, wherein the first elastic component and the second elastic component are both sleeved on the guide shaft, and the tensioning unit is located between the first elastic component and the second elastic component.

3. The chain saw according to claim 2, wherein the first elastic component is close to the first handle and the second elastic component is close to the chain saw bar assembly along the first direction, and the first elastic component is shorter on the length compared to the second elastic component along the first direction, such that the tensioning unit deviates toward a side of the first elastic component at an initial position.

4. The chain saw according to claim 2, wherein the tensioning assembly comprises a compressing block, an end of the second elastic component away from the tensioning unit abuts again the compressing block, to limit the move distance of the tensioning assembly along the first direction.

5. The chain saw according to claim 1, wherein the adjustment assembly comprises a threaded column penetrating through the side cover and being connected to an outside wall of the first housing, a hand wheel rotatably connected to an end of the threaded column, and a locking part sleeved on the threaded column and accommodated in the hand wheel; and the locking part can move along a direction of the threaded column driven by the hand wheel, so as to fasten or loosen the chain saw bar assembly between the first housing and the side cover.

6. The chain saw according to claim 5, wherein a blocking wall protruding along the direction of the tensioning assembly is formed on the locking part, the blocking wall spiraling hovering around the threaded column, to form a spiral groove to clamp the tensioning unit; the tensioning unit provides the positioning protrusion to be clamped by the spiral groove, and the positioning protrusion can relatively slide in the spiral groove, so as to make the guide bar move along the first direction forth and back.

7. The chain saw according to claim 1, wherein a convex plate is set on the first housing, the convex plate is set with an accommodating groove to accommodate the tensioning assembly, and the chain saw bar assembly is locked and connected between the convex plate and the side cover by the cooperation of the tensioning assembly and the adjustment assembly.

8. The chain saw according to claim 1, wherein the motor comprises a chain wheel for driving the saw chain, and the chain wheel penetrates through the outside wall of the first housing and is positioned between the side cover and the first housing.

* * * * *